United States Patent [19]

Dunn

[11] Patent Number: 4,866,900

[45] Date of Patent: Sep. 19, 1989

[54] DRYWALL FURRING SYSTEM

[75] Inventor: James J. Dunn, St. Charles, Ill.

[73] Assignee: Chicago Metallic Corporation, Chicago, Ill.

[21] Appl. No.: 124,158

[22] Filed: Nov. 23, 1987

[51] Int. Cl.[4] ..... E04B 5/55

[52] U.S. Cl. ..... 52/488; 52/484; 52/667; 52/DIG. 5; 403/363

[58] Field of Search ..... 52/488, 484, 667, DIG. 5, 52/726, 729, 732, 483; 403/363

[56] References Cited

U.S. PATENT DOCUMENTS

| | | | |
|---|---|---|---|
| 3,175,655 | 3/1965 | Brown et al. . | |
| 3,290,075 | 12/1966 | Jahn | 52/484 |
| 3,333,379 | 8/1967 | Harris . | |
| 3,367,695 | 2/1968 | Haertel et al. | 52/484 |
| 3,496,690 | 2/1970 | Jahn | 52/726 |
| 3,501,185 | 3/1970 | Brown et al. . | |
| 3,503,641 | 3/1970 | Fraser . | |
| 3,778,947 | 12/1973 | Sauer | 52/484 |
| 3,846,031 | 11/1974 | Adams . | |
| 4,062,301 | 12/1977 | Pitchford . | |
| 4,208,851 | 6/1980 | Sauer | 52/667 |
| 4,266,384 | 5/1981 | Orals et al. . | |
| 4,364,215 | 12/1982 | Gailey et al. . | |
| 4,525,973 | 7/1985 | Vukmanic et al. | 52/484 |
| 4,677,802 | 7/1987 | Vukmanic | 52/488 |

FOREIGN PATENT DOCUMENTS

| | | | |
|---|---|---|---|
| 620469 | 5/1961 | Canada | 52/488 |

*Primary Examiner*—Michael Safavi

*Attorney, Agent, or Firm*—Hill, Van Santen, Steadman & Simpson

[57] ABSTRACT

A grid system for suspending a ceiling formed of drywall includes main runners which are interconnected by splice connections having an arrangement for controlling bending to relieve thermal expansion and has cross members formed of channels which are connected to the main runner by a connection having an arrangement for relieving thermal expansion. The splice connection includes a portion of the bead of the main runner being removed to provide bending lines spaced inward from the edge of the web so that bending will occur at two spaced positions at the splice connection to relieve thermal expansion caused by a fire. The connection between the channel cross members and the main runners includes flanges of each of the cross members having a first notch separated from a second notch by a shear tab, the connection is formed by the edge of the aperture in the web of the main runner being received in the first notch and the shear tab being broken off or removed in response to forces of thermal expansion caused by a fire.

12 Claims, 2 Drawing Sheets

DRYWALL FURRING SYSTEM

BACKGROUND OF THE INVENTION

The present invention is directed to a fire resistant ceiling supporting system particularly useful for supporting a drywall ceiling. The system is capable of absorbing thermal expansion without any substantial buckling of the members so that the drywall ceiling will not collapse during abnormal elevated temperatures thereby preserving the integrity of the ceiling as a barrier under fire conditions.

A fire rated drywall ceiling support system is disclosed in U.S. Pat. No. 4,208,851. In this system, main runners, which are substantially a T-shaped member having a bead along one edge of a web and flanges on the opposite edge, are spliced together with a particular splice that allows for compensation of thermal expansion of the main runners caused by fire. The relief of the thermal expansion occurs in the area of the splice.

This system also has channel-shaped cross members extending between the main runners on which the drywall can be secured. These cross members have a channel-shaped member with upstanding side walls with outwardly extending flanges, with the flanges being provided with notches. The ends of the flanges are inserted into the main runner with the notch receiving or engaging the web. Due to a cam base of the notch, expansion is compensated by the cross channel extending further into the apertures of the web. However, a firm, stable construction is not always present.

SUMMARY OF THE INVENTION

The present invention is directed to providing a fire rated suspension ceiling for a drywall ceiling in which the cross members have a substantially firm connection with the main runners which, however, is yieldable when subjected to thermal expansion to prevent uncontrolled buckling. In addition, the main runners are provided with an improved splice connection which allows for controlled expansion when subjected to elevated temperatures caused by fire.

To accomplish these goals, the present invention includes a system having cross-channel members which provide surfaces for mounting a drywall material and main runners. The main runners have spaced apertures in their webs and the cross-channels have a channel structure with a flat base connected to two side walls that extend substantially upward and terminate in outwardly extending flanges. Each end of the cross members has a portion of the flat base and adjacent side walls cut away to form prongs with an inwardly tapering flange construction with a first notch separated by a tab from a second, axially elongated notch. When mounted in the main runner, the cross member is held in a stable position by the web of the main runner being received in the first notch of each prong. However, when subjected to thermal expansion because of a fire, the tab separating each first notch from the second notch can be sheared off to allow expansion and a further penetration of the prongs at the end of the cross member into the web.

The main runners each have a web with a bead adjacent one edge and a pair of flanges on opposite sides of the web adjacent the other side. Each of the main runners is interconnected together by an integral tongue of the runner extending outwardly from the web and having coacting abutment surfaces to interlock the two tongues together. In order to allow for thermal expansion, the flanges are cut back a given distance from the end of the web, and each of the beads is provided with a notch, which extends through the entire bead and is spaced approximately the same distance as the cutaway portion of the flange. When subjected to a thermal expansion from an elevated temperature, the main runners will bend on two axially spaced lines, which pass through each of the notches in the beads and the interconnected tongues will remain substantially unbent, but having their free ends moved out of the plane of the web so that a substantial S-shaped bend is made as the flange of one runner shifts laterally relative to the flange of the other runner.

Other advantages and features will become readily apparent from the following description of the preferred embodiments, the claims and drawings.

DESCRIPTION OF THE PREFERRED EMBODIMENTS

Figure 1:
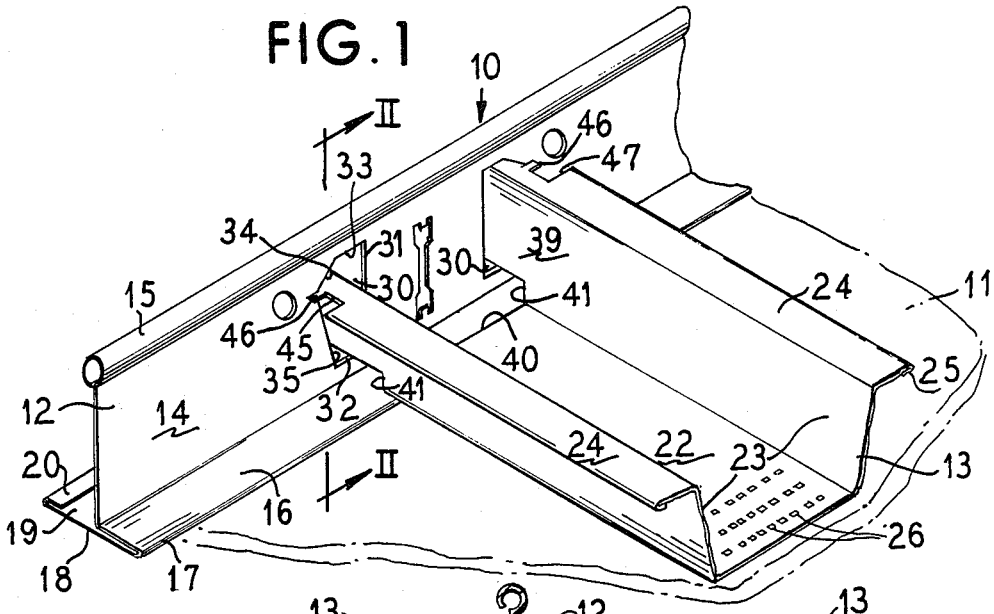
FIG. 1 is a perspective view of a connection between the main runner and a cross member.

The principles of the present invention are particularly useful when incorporated in a furring system, generally indicated at 10 in FIG. 1, for supporting drywall ceiling panels 11. The system 10 includes main runners 12 and cross members or runners 13, which are interconnected to the main runners 12.

Each of the main runners 12 is formed of a single sheet of metal which is bent to provide a web 14 with a circular bead 15 along one side. At a side opposite the bead 15, the sheet of metal has an outwardly extending flange 16, which terminates in a reversed bend 17 with the next portion 18 passing under the web 14 to form an opposite flange 19 that is illustrated as having a turned-in lip 20.

Each of the cross members 13 has a channel-shaped configuration with a flat base 22 and a pair of upstanding side walls 23. Each of the side walls 23 terminates in an outwardly extending flange 24, which is illustrated as having a folded-over edge 25. Due to the construction of the side walls 23, the flanges are resiliently biased outward to the position illustrated in the Figures, and can be squeezed to be moved inwardly. The base 22 is provided with nailing indents, such as 26, so that the drywall panel 11 can be secured to the base by nails or threaded fasteners.

To form a connection between the cross members such as 13 and the main runner 12, the web 14 of the main runner is provided with a pair of spaced apertures 30, which are illustrated as having a five-sided configuration. For example, the apertures 30 have one side 31 with two parallel extending edges 32 and 33. The remaining two sides 34 and 35 extend at angles other than right angles from the sides 32 and 33 and join at an angle which is closer to the side 33 than to the side 32. The size of the aperture such as 30 is such that an end prong 39 of the cross member 13 can be received therein.

Figure 2:
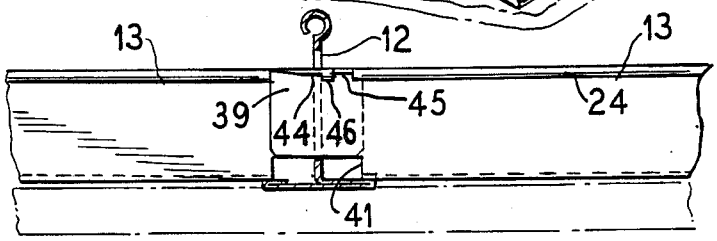
FIG. 2 is a cross sectional view, with portions broken away for purposes of illustration, taken along lines II—II of FIG. 1 of two cross members being connected in a line with each other through a common main runner.
Figure 3:
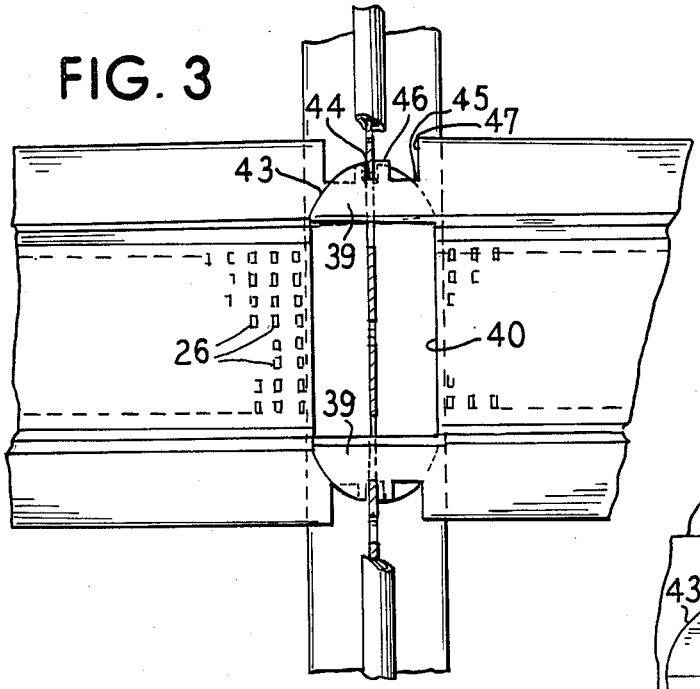
FIG. 3 is a plan view of the connection of FIG. 2, with portions broken away for purposes of illustration.

The end of each of the cross members 13 has a portion of the base 22, as well as adjacent portions of the side walls 23, cut back to form an end line 40 for the base and a notch 41 (see FIG. 2). The flange, such as 24, as illustrated in FIG. 3, has a curved end portion 43, which ends in a first notch 44. It is noted that this curved or tapering portion 43 has a width substantially less than the major width of the flange 24 and this forms the end prong 39, which is smaller in width than the flange 24. The first notch 44 is axially spaced from a second notch 45 by a tab 46. To form the connection, the two flanges 24 are moved towards each other by squeezing of the side walls 23 and the end prongs 39 are inserted into the apertures 30. When the first notches 44 become aligned with the web 14, the side walls are released so that the edge of the web 14 is received in the first notches 44. As this happens, the flat base 22 has a portion resting on a flange of the main runner.

Figure 4:
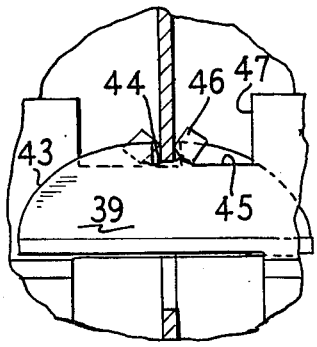
FIG. 4 is an enlarged plan view similar to a portion of FIG. 3, showing the shear tabs being broken away during initial thermal expansion.

As illustrated in FIGS. 2, 3 and 4, when cross members 24 are inserted from both sides, the ends are telescopically received one on top of the other. Thus, as best illustrated in FIG. 3, the edges of the web 14 are received in the notches 44 of each of the flanges 24 for the cross members. The tabs, such as 46, provide a substantially stable connection between each cross member 13 and the main runner 12.

During a fire, the expansion of the cross member, such as 13, will create forces to cause the cross members to be pushed further into the web from each side so that the tabs 46 will be sheared off, as illustrated in FIG. 4. Thus, the notch 44 and the notch 45 become interconnected with the removal of the tab 46 to provide a substantially long axial extent for these combined notches 44 and 45. Since the notch 45 can be approximately ½ inch, this allows a deeper penetration of the end prongs 39 and an expansion between the main runner and the member of approximately ½ inch. As illustrated in FIG. 4, the tabs on both runners coming from opposite sides are being sheared off so that the end prongs of each runner can penetrate inward and this penetration is only limited by a rear edge 47 of the notch 45. It is also noted that, due to the undercut 41, the rear edge 47 is closer to the end than the edge formed by the undercut, 41 so that when the edge 47 abuts against the web, the end 40 of the base 22 has not yet engaged the web 14.

Figure 7:
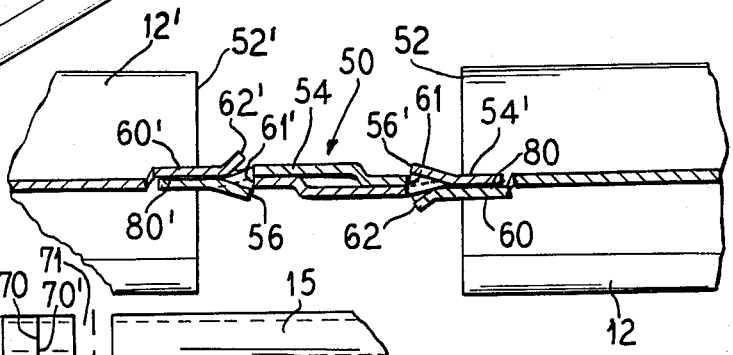
FIG. 7 is a cross sectional view taken along the lines VII—VII of FIG. 6.

To provide a fire rating for the main runner 12, the runners 12 are provided with means to enable controlled expansion. The main runners 12 are spliced together by a splice connection, generally indicated at 50 in FIGS. 6 and 7. The splice connection 50 is provided by each end of the main runner being fashioned in the following manner. The portion forming the flanges 16 and 19 are cut back so that they terminate a fixed distance from an end surface 51 of the web (see FIG. 5). This cut back provides an end surface or edge 52 for the flanges. Extending out of the end surface 51 of the web 14 is an integral tongue 54, which has a deformed portion 55 forming a first abutment surface 56 which is spaced inward of a free end 57 of the tongue 54. In the web 14, a loop 60 is cut and pressed out of the web to form a second abutment surface 61. The loop 60 has a flap 62 to aid in guiding the tongue into the loop during assembly of the connection 50. The two members 12 and 12' are interconnected with their tongues 54 and 54' received in loops 60' and 60, as illustrated in FIGS. 6 and 7. As illustrated, the first abutment surface 56' of the tongue 54' is received on the abutment surface 61 as the end of the tongue 54' is inserted in the loop 60. At the same time, the end of the tongue 54 is received in a loop 60' so that the first abutment 56 is engaged on the abutment surface 61'. The insertion of the free ends of the tongues 54 and 54' in the loops 60' and 60 causes the free end to be urged against a surface 80 or 80' of the loops 60 and 60'. As this happens, the end of the webs 51 and 51' are in abutting relation with each other, as well as ends 70 and 70' of the beads 15 and 15'.

Figure 5:
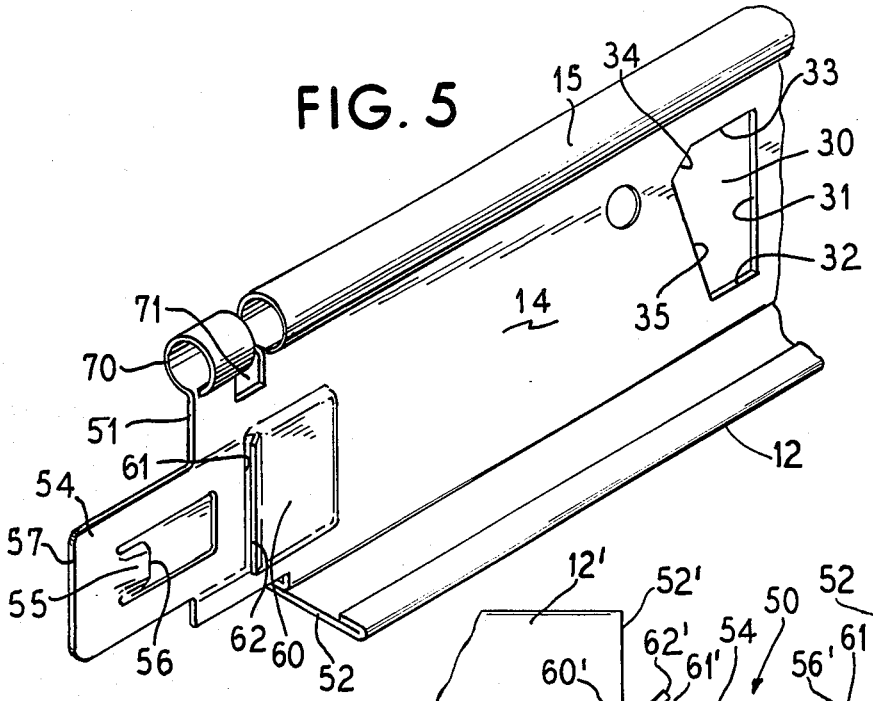
FIG. 5 is a perspective view of an end connection on the main runner.
Figure 6:
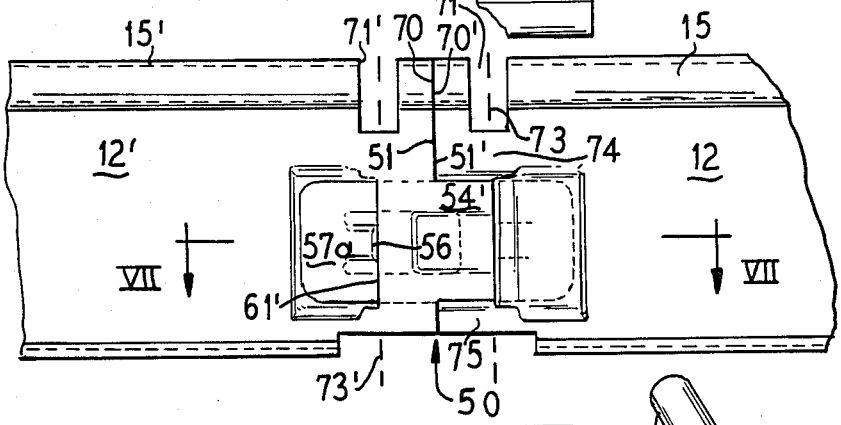
FIG. 6 is a side view of a splice connection between two main runners.

As best illustrated in FIGS. 5 and 6, the beads 15 and 15' have a notch 71 and 71', respectively, which are spaced inward from the abutting surfaces 70 and 70'. As illustrated in FIGS. 5 and 6, this notch 71 extends completely through the bead 15 so that the portions of the bead forming the bead's end surface 70 is separated from the remaining portion of the bead 15. The notch 71, as illustrated, is spaced closer to the end 51 of the web than the end surface 52, but is vertically aligned with the second abutment surface 61. This provides a weakening along a line 73 and 73', respectively, for the runners 12 and 12'.

Figure 9:
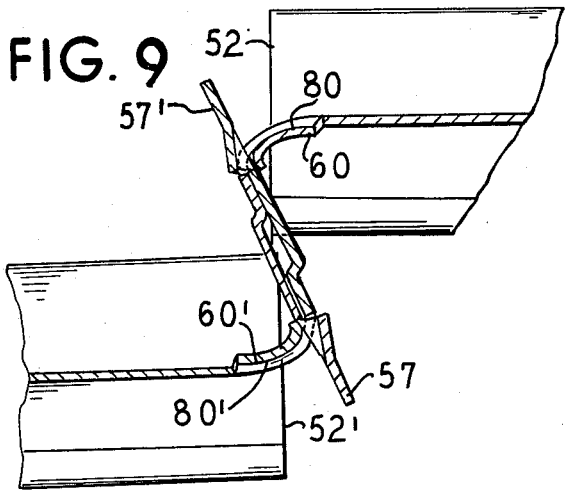
FIG. 9 is a cross sectional view similar to FIG. 7 of the joint after expansion, such as illustrated in FIG. 8.
Figure 8:
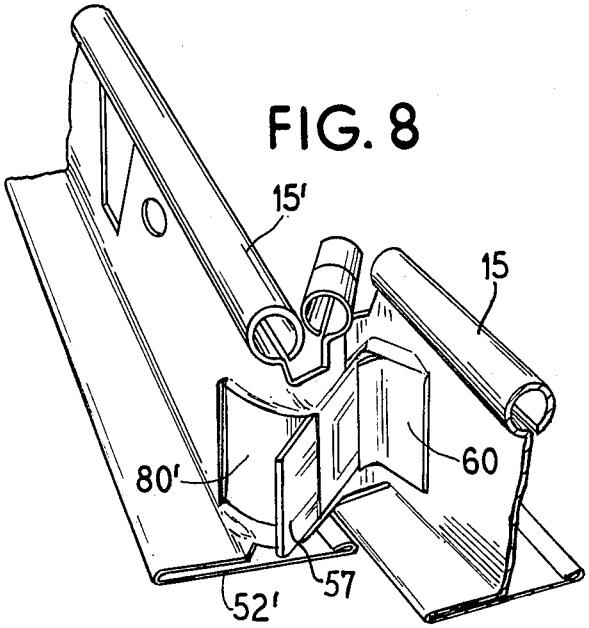
FIG. 8 is a perspective view of the splice connection of FIG. 6 after relieving of the expansion forces.

As illustrated in FIGS. 8 and 9, when the main runners are subjected to an elevated temperature, they will relieve the expansion forces in a controlled manner by bending approximately on the lines 73 and 73', which extend through the two notches 71 and 71'. This bending along the two spaced lines occurs with bending in the web portion 74 and 75. This bending will cause the flanges to move laterally relative to each other so that the end surfaces, such as 52, will move to be laterally offset from each other, as the web bends at substantially right angles. It is noted that neither of the tongues 54 or 55 are bent and remain substantially undisturbed. However, free ends, such as 57', will move away from the adjacent surface 80 of the loops 60, as illustrated.

The structure of the splice allows for a good contact between the end surfaces of the webs and the beads while making the splice, but still allows for a controlled bending to relieve forces created by thermal expansion. It is also noted that with the bending, there is no forces provided that would disturb the actual splice between the two tongues, since the tongues themselves are not bent.

Another advantage are the facts that the splice was made without permanently bending any of the tongue portions and that the bends occur in a single thickness of the web material.

Although various minor modifications may be suggested by those versed in the art, it should be understood that I wish to embody within the scope of the patent granted hereon all such modifications as reasonably and properly come within the scope of my contribution to the art.

I claim:

1. A grid system for supporting drywall comprising main runners and cross members connected between said main runners, each of said main runners having a T-shape with a web having a bead along one side of the web and outwardly extending flanges adjacent another side of the web, said main runners at spaced positions having a pair of apertures in the web for receiving ends of the cross members; each of the cross members being a one-piece channel member having a base with upstanding side walls terminating in outwardly extending flanges, each cross member having ends with a portion of the base and portions of the adjacent side walls removed to form two prongs of remaining portions of the side wall and flanges, said prongs having means for forming a connection with the web of the main runner and allowing for expansion due to elevated temperature, said means comprising each of the flanges of the cross member having a first notch separated by a shear tab from a second notch, said connection being formed by the prongs being inserted through the pair of apertures and an edge of the web surrounding each aperture being received in said first notch, so that when axial forces due to thermal expansion are applied to the cross member, the tabs are sheared off to allow further penetration of the prongs through the web.

2. A grid system according to claim 1, wherein the first notches of the cross member have a width approximately equal to the thickness of the web.

3. A grid system according to claim 1, wherein a width of the flange of the cross member in the region of the prong and shear tab is less than a major width of said flange so that once the shear tab is removed a rear edge of the second notch forms a large area abutment surface for engaging the web to limit the amount of insertion of the prongs through the web.

4. A grid system according to claim 1, wherein each of the main runners has end means for forming a splice connection with an adjacent main runner, said splice connection having fold means for relieving thermal expansion in the main runners.

5. A grid system according to claim 4, wherein the end means in the main runners includes each flange of each of the main runners having a portion removed adjacent an end of the web, and a tongue extending from the end of the web, said tongue having first means coacting with second means of the web of the adjacent main runner for forming a splice connection therebetween, and said fold means includes the bead of the main runner having a notch extending completely through the bead inward of the end of the web to form a fold line so that folding may occur along two spaced lines at the splice connection.

6. A grid system according to claim 5, wherein the first means of the tongues comprises a first abutment surface, and the second means includes each of the webs being provided with a bent-out loop portion providing a second abutment surface in the web, said tongues being inserted in the loop of the adjacent main runner with the first abutment surface of the tongue cooperating with the second abutment surface of the web of the adjacent main runner, said second abutment surface being positioned under the notch in the bead so that the bend line extends approximately along said second abutment surface.

7. A fire rated splice connection between a pair of runners, each of said runners having a web with a bead along one side of the web and outwardly extending flanges along an opposite side, the web and bead of each of the runners terminating at an end surface, said flanges terminating inward of the end surface of said web and a tongue extending from the end surface of the web and having means for forming a first abutment surface cooperating with a second abutment surface formed in the web of an adjacent runner of the pair to form the splice connection, said bead having a notch spaced inward from the end surface of the web and bead, said notch extending completely through the bead and into the web to form a bend line inward of the end surface of the web so that during thermal expansion of the runners of the splice connection, bending will occur on two spaced lines of the connection with the webs of the two runners moving laterally relative to each other to relieve forces created by the thermal expansion.

8. A fire rated splice connection according to claim 7, wherein the second abutment in each of the webs for engaging the first abutment on the tongue comprises an edge of the web created by a loop portion being diecut from the web, said second abutment surface being approximately on the bend line passing through the notch in the bead.

9. A fire rated splice connection according to claim 8, wherein a free end of each of the tongues is received in the loop portion of the adjacent runner.

10. A fire rated splice connection according to claim 9, wherein the flanges each runner terminate at a point spaced further inward from the end surface than the notch so that the bend line is formed between the ends of the flanges and the end surface of the web.

11. A fire rated splice connection according to claim 7, wherein each of the runners has spaced apertures in the web for forming connections with channel-shaped cross members to form a grid system.

12. A fire rated splice connection according to claim 11, wherein each of channel-shaped cross members has a base with upstanding side walls extending into outwardly extending channel flanges, said flanges and side walls at each end of the cross member being shaped to form prongs having means for forming a connection capable of relieving thermal expansion, said means for forming a connection including first notches for receiving edges of the apertures of the web of runner, said first notches being separated form second notches by a shear tab removable in response to thermal expansion in the cross member.

* * * * *